US009422700B2

(12) United States Patent
Kutsch et al.

(10) Patent No.: US 9,422,700 B2
(45) Date of Patent: Aug. 23, 2016

(54) SHEET CATCHER FOR TOILETS AND METHODS THEREFOR

(71) Applicant: Medline Industries, Inc., Mundelein, IL (US)

(72) Inventors: John Kutsch, Crystal Lake, IL (US); Vince Lackowski, Harvard, IL (US); Sharbel Maalouf, Pleasant Prairie, WI (US); Lorie Rowe, McHenry, IL (US)

(73) Assignee: Medline Industries, Inc., Mundelein, IL (US)

( * ) Notice: Subject to any disclaimer, the term of this patent is extended or adjusted under 35 U.S.C. 154(b) by 486 days.

(21) Appl. No.: 13/915,213

(22) Filed: Jun. 11, 2013

(65) Prior Publication Data

US 2014/0359928 A1 Dec. 11, 2014

(51) Int. Cl.
*E03D 9/00* (2006.01)
*E03D 11/00* (2006.01)

(52) U.S. Cl.
CPC . *E03D 9/00* (2013.01); *E03D 11/00* (2013.01); *Y10T 29/49826* (2015.01)

(58) Field of Classification Search
CPC ..... E03D 9/00; E03D 11/00
USPC ..... 4/256.1, 286, 255.01
See application file for complete search history.

(56) References Cited

U.S. PATENT DOCUMENTS 1,261,444 A * 4/1918 Schied ..... E03C 1/302 15/104.001
2,393,603 A * 1/1946 Beeth ..... E21B 3/04 173/149
2,811,724 A * 11/1957 Click ..... E03D 9/00 24/370
5,769,960 A * 6/1998 Nirmel ..... E03C 1/302 134/22.11
6,094,765 A * 8/2000 Askenase ..... E03D 9/00 15/104.05
6,775,873 B2 * 8/2004 Luoma ..... E03C 1/302 15/104.001
D657,099 S * 4/2012 Zach ..... D32/14
8,201,281 B2 * 6/2012 Hanifl ..... E03D 11/00 4/256.1
8,365,337 B2 * 2/2013 Tash ..... B08B 9/045 15/104.001

* cited by examiner

*Primary Examiner* — Huyen Le
(74) *Attorney, Agent, or Firm* — Philip H. Burrus, IV

(57) ABSTRACT

An apparatus (100) for a toilet (600) is provided. The apparatus can include a rim engagement portion (101) and a sheet catcher (102) comprising one or more barbs (104,105,106). A bowl side bestrider (103) can couple the rim engagement portion to the sheet catcher. The sheet catcher to situate within a water seal (605) of the toilet when the rim engagement portion engages a rim (601) of the toilet. The barbs can to catch non-dispersible sheets (701) when the toilet is flushed.

18 Claims, 12 Drawing Sheets

SHEET CATCHER FOR TOILETS AND METHODS THEREFOR

BACKGROUND

1. Technical Field

This disclosure relates generally to toilets, and more particularly to devices for toilets.

2. Background Art

Manufacturers of health care products manufacture cloth wipes and other sheet devices for personal hygiene of patients. For example, wipes and other cloths can be used for cleaning the skin and for dealing with incontinence care. Such wipes are often disposable. Some wipes are designed to breakdown and disperse after use while others are substantially non-dispersible. This non-dispersible property allows them to be used with water during patient cleaning. Additionally, the non-dispersible property allows some cloths to be pre-moistened with rinse-free fluids that clean, moisturize, condition and soothe the skin.

Since they are frequently designed as "single use" items, and as they are frequently used for cleaning patient waste, some may attempt to dispose of these sheets by flushing them down the toilet. For dispersible products, such as toilet paper, this is not a problem since the water in the toilet breaks down their materials. However, for non-dispersible sheets, accumulation in the trapway or other parts of a toilet can lead to a variety of problems, including stoppage of the toilet, blockage of the exhaust system leading away from the toilet, malfunction of septic tanks or sewage systems, or other maladies.

It would be advantageous to have an apparatus to reduce these problems.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
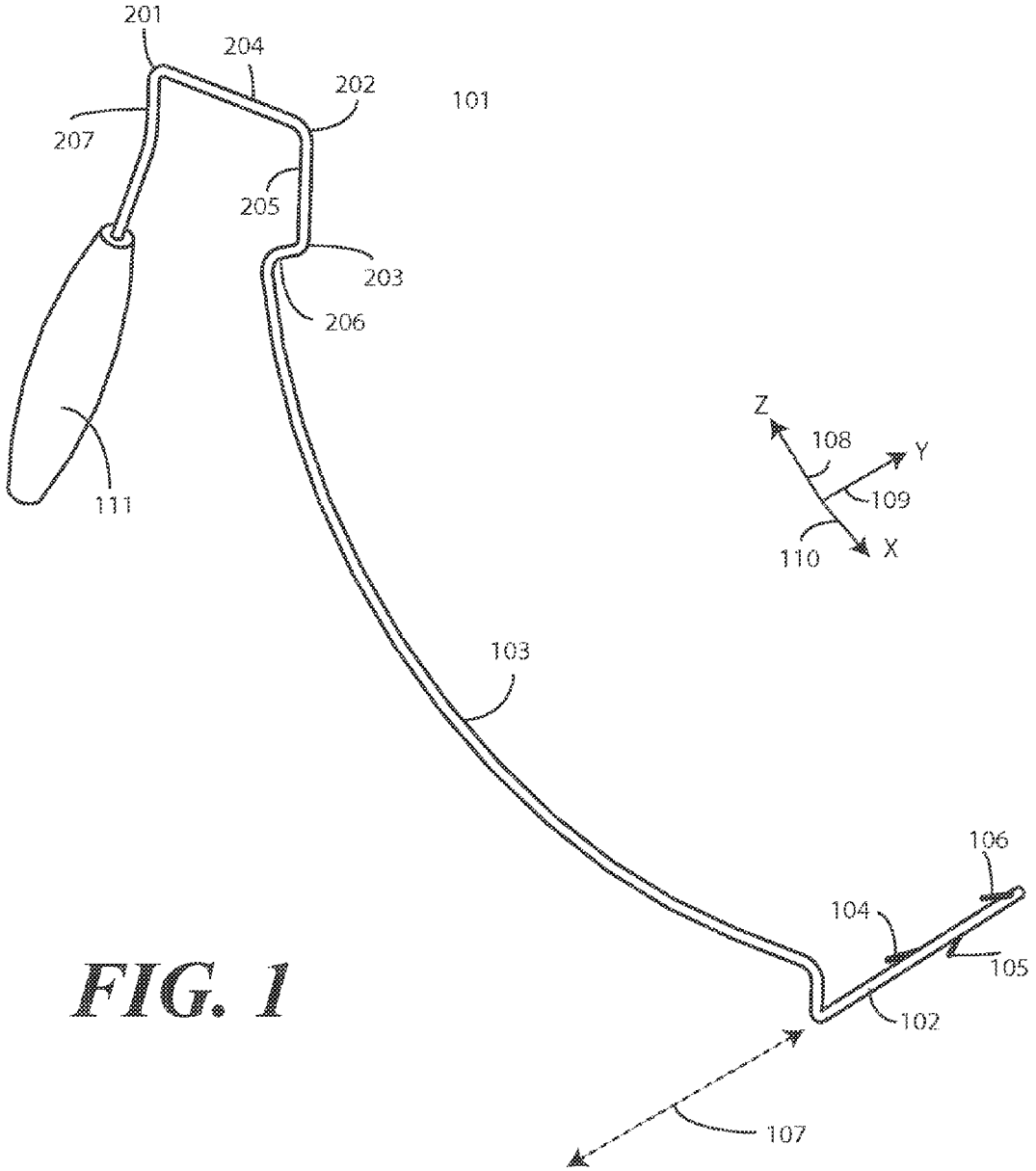
FIG. 1 illustrates a perspective view of one explanatory apparatus configured in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Prior art attempts at solving the problems described above have been cumbersome, expensive, and difficult to use. For example, U.S. Pat. No. 8,201,281 to Hanifl et al., incorporated herein by reference, discloses a trapping device for non-dispersible cloths. In the '281 patent, a trapping device involves wrapping a metal strap into a circle. The strap must then be permanently installed into the trapway of a toilet bowl with a screw. A staple leg, which is a bent piece of strap metal, then attempts to catch non-dispersible cloths about its perimeter, while allowing other materials to pass through.

In practice, the strap of the '281 patent has problems. First, the strap must be permanently installed by a specialized technician. Next it requires a special sizing tool to form the strap to the proper size. Once installed, a person must reach into the water with a special set of pliers to remove a protective foam ring. Each of these steps is very user-unfriendly. The steps are also costly and time consuming.

The foremost problem with the strap of the '281 patent is that when non-dispersible cloths are captured, a user must reach into the bowl with a retriever to "unsnag" the non-dispersible cloths from the strap. This is a tedious chore, can result in the user actually pushing the non-dispersible cloth further into the trapway or into the exhaust completely, and requires the user to place their hands in an unsanitary position.

Embodiments of the disclosure provide a simpler, less expensive, faster, and more user-friendly apparatus and method for catching non-dispersible sheets. In one embodiment, an apparatus includes a rim engagement portion, a sheet catcher that includes one or more barbs, and a bowl side bestrider coupling the rim engagement portion to the sheet catcher. The apparatus can be manufactured from a pliant metal wire or other material and is vastly easier to use than the strap of the '281 patent. Moreover, the apparatus is far more hygienic for the user. The apparatus has been tested—and can be used—with a variety of toilet types. One or more embodiments are especially useful when used with pressure-jet assist toilets, such as those used in medical and health care service facilities.

Embodiments of the disclosure resulted from extensive experimental testing. More than a dozen different apparatuses were tested using the Maximum Performance (MaP) Testing Toilet Fixture Performance Testing Protocol, Version 5, which was promulgated in March of 2013. The embodiments disclosed below were tested more than twenty times using simulated human waste, as specified in the MaP, dispersible toilet tissue as specified in the MaP, and non-dispersible sheets manufactured from a needle-punched material and measuring eight inches square. During the twenty-seven tests, embodiments described herein caught the non-dispersible sheet every time, thereby exceeding the inventors desired catch rate of eighty-one percent. This compares with a success rate of only fifty-nine percent with other attempted designs. The results of the experimental testing are shown in the following table:

TABLE 1

| | Selected Design | | | Alt Design | | |
|---|---|---|---|---|---|---|
| Test | Pass | Incomp. | Fail | Pass | Incomp. | Fail |
| 1 | X | | | X | | |
| 2 | X | | | | | X |
| 3 | X | | | X | | |
| 4 | X | | | X | | |
| 5 | | X | | X | | |
| 6 | X | | | | | X |
| 7 | X | | | X | | |
| 8 | X | | | | X | |
| 9 | | | | X | | |
| 10 | | X | | X | | |
| 11 | X | | | | X | |
| 12 | X | | | | | X |
| 13 | X | | | X | | |
| 14 | X | | | X | | |
| 15 | | | X | X | | |
| 16 | X | | | | X | |
| 17 | X | | | | | X |
| 18 | X | | | X | | |
| 19 | X | | | | | X |
| 20 | X | | | X | | |
| 21 | X | | | X | | |
| 22 | | X | | | | X |
| 23 | X | | | X | | |
| 24 | X | | | X | | |
| 25 | X | | | | X | |
| 26 | X | | | | | X |
| 27 | | | X | X | | |
| Total | 22 | 3 | 2 | | | |
| Pctg. | 81% | 11% | 7% | 59% | 15% | 26% |

In one embodiment, an apparatus for catching non-dispersible sheets includes a rim engagement portion, a sheet catcher comprising one or more barbs, and a bowl side bestrider coupling the rim engagement portion to the sheet catcher. When the rim engagement portion is coupled to the rim of a toilet, the bowl side bestrider bestrides the inner surface of the bowl. The sheet catcher is situated within a water seal of the toilet when the rim engagement portion engages a rim of the toilet. When non-dispersible sheets are flushed, the barbs to catch the sheets while letting dispersible sheets and human waste pass by.

Embodiments of the disclosure are simple and inexpensive to manufacture. In one embodiment, a sheet-catching apparatus is manufactured from a pliant metal wire. For example, a sheet-catching apparatus configured in accordance with one or more embodiments of the disclosure can be manufactured from a preformed, twelve-gauge, aluminum wire. The sheet catcher can be formed with three or more barbs of eighteen to twenty gauge stainless steel barbs. The form of the rim engagement portion and the bowl side bestrider can be such as to sit against the rim contour and bowl contour of a toilet in one or more embodiments. A handle can extend from the rim engagement portion so that a health care services provider can easily detach the device from the rim and extract non-dispersible sheets without having to either touch the toilet or place their hands into the bowl.

When the sheet catcher is placed within the water seal such that it at least partially extends into the trapway, the one or more barbs have been found through experimental testing to catch non-dispersible sheets while allowing other materials to pass. Specifically, when test media, i.e., simulated human feces, produced according to the MaP industry standard protocol and toilet paper were flushed with non-dispersible sheets, the barbs of the sheet catcher caught the sheet while allowing the other materials to pass. The tester was then able to conveniently and quickly remove the non-dispersible sheet to a waste receptacle without touching the toilet or placing their hands beneath the rim of the bowl.

Figure 2:
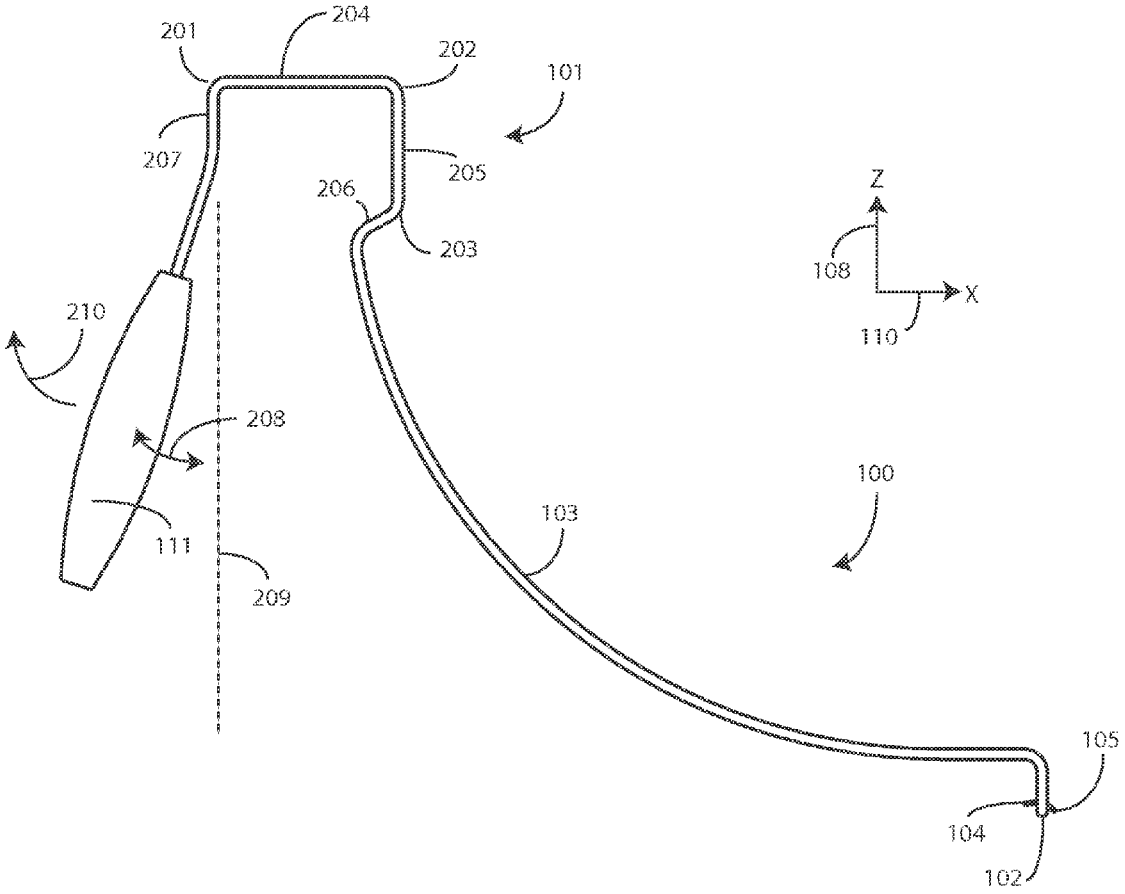
FIG. 2 illustrates a side elevation view of one explanatory apparatus configured in accordance with one or more embodiments of the disclosure.
Figure 3:
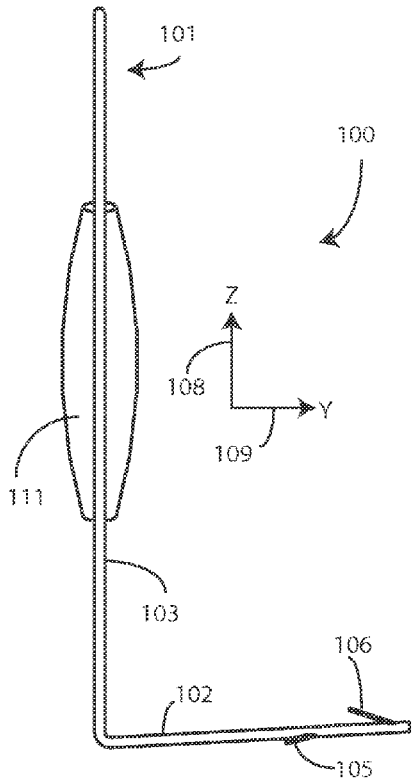
FIG. 3 illustrates a front elevation view of one explanatory apparatus configured in accordance with one or more embodiments of the disclosure.
Figure 4:
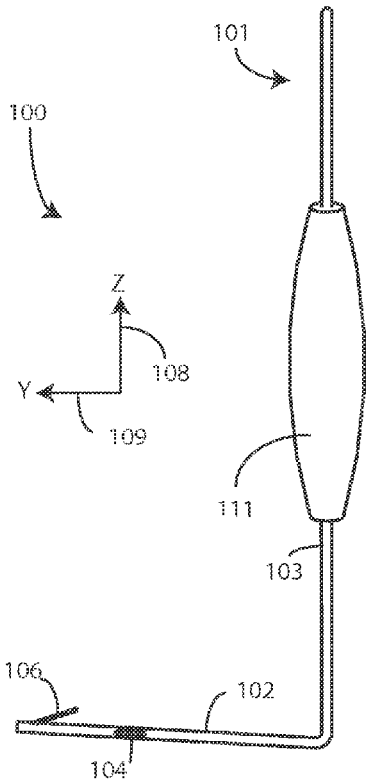
FIG. 4 illustrates a rear elevation view of one explanatory apparatus configured in accordance with one or more embodiments of the disclosure.
Figure 5:
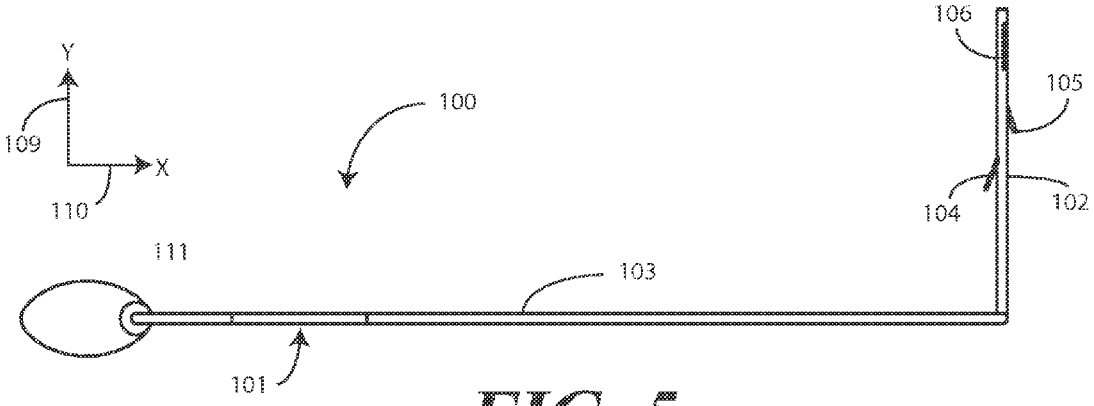
FIG. 5 illustrates a top plan view of one explanatory apparatus configured in accordance with one or more embodiments of the disclosure.

Turning now to FIGS. 1-5, illustrated therein is one example of an apparatus 100 for catching sheets configured in accordance with one or more embodiments of the disclosure. FIG. 1 illustrates a perspective view of the apparatus 100, while FIG. 2 illustrates a side elevation view thereof. FIG. 3 illustrates a front elevation view of the apparatus 100, while FIG. 4 illustrates a rear elevation view thereof. FIG. 5 illustrates a top plan view of the apparatus 100.

In one embodiment, the apparatus 100 includes a rim engagement portion 101, a sheet catcher 102, and a bowl side bestrider 103. In this embodiment, the bowl side bestrider 103 couples the rim engagement portion 101 to the sheet catcher 102.

In one embodiment, the sheet catcher 102 has a length of between four and five inches. Experimental testing has shown that a length of about 4.11 inches is highly effective in most pressure-jet assist toilets. The term "about" is intended to describe a dimension inclusive of manufacturing tolerances. Accordingly, a dimension of "about 4.11 inches" having a manufacturing tolerance of plus or minus 0.10 inches can be between 4.01 inches and 4.21 inches, inclusive.

In one embodiment, the sheet catcher 102 has one or more barbs 104,105,106 extending therefrom. Experimental testing has shown that three barbs 104,105,106 are effective in catching non-dispersible sheets while allowing other materials to pass. More barbs can be used. However, they may result in some other matters being caught in addition to the non-dispersible sheet.

In one embodiment, the three barbs 104,105,105 are spaced from each other about an axis 107 of the sheet catcher 102. As shown in FIG. 1, one barb 106 extends from the axis 107 along a plane defined by the z-axis 108 and the y-axis 109 at an angle of about 150 degrees relative to the y-axis 109 where the y-axis 109 is defined by the axis 107 of the sheet catcher 102. In one embodiment, another barb 104 extends along a plane defined by the x-axis 110 and the y-axis 109 at an angle of about 201 degrees relative to the x-axis 110.

In one embodiment, a third barb 105 extends in a quadrant defined by the negative z-axis 108 and the x-axis 110 at an angle of approximately 150 degrees relative to the z-axis 108. Accordingly, the third barb 105 is extends below the sheet catcher 102 in this illustrative embodiment. Having at least one barb 105 extend beneath the sheet catcher 102 can be advantageous in that the lower barb 105 can serve as a "foot" to raise the sheet catcher 102 slightly off the bottom of a trapway of a toilet. This can lead to a better non-dispersible catch rate according to experimental testing. Note that the embodiment of FIGS. 1-5 is has been shown to be advantageous in experimental testing. However, other barb configurations will be obvious to those of ordinary skill in the art having the benefit of this disclosure.

In one embodiment, the bowl side bestrider 102 is curved so as to be able to sit against the inner surface of a toilet bowl. In one embodiment, the bowl side bestrider 102 has a radius of between seven and eight inches. Experimental testing has shown that a radius of about 7.77 inches is well suited for most pressure-jet assist toilets. Other radii will be obvious to those of ordinary skill in the art having the benefit of this disclosure.

In one embodiment, the rim engagement portion 101 is configured to partially surround the rim of a toilet so as to be detachable from the rim when the pliant material of the apparatus 100 is deformed. In the illustrative embodiment of FIGS. 1-5, the rim engaging portion 101 comprises three or fewer corners 201,202,203 separated by two rim engaging sides 204,205. In one embodiment, rim engaging side 204 is between two and three inches in length. An explanatory length is about 2.55 inches. In one embodiment, rim engaging side 205 is between one and two inches in length. An explanatory length is about 1.80 inches. In one embodiment, rim engaging side 204 is between nine and ten inches above the axis 107 defined by the sheet catcher 102. An explanatory height above this axis 107 is about 9.6 inches.

In this illustrative embodiment, two of the corners 201,202 are substantially orthogonal, while a third corner 203 defined an obtuse angle. In this illustrative embodiment, the third corner 203 couples a rim-latching arm 206, which extends from rim engaging side 205 at an obtuse angle. Corner 201 also has a partial rim engaging side 207 extending therefrom.

As will be shown in FIGS. 6-9 below, in operation the rim engaging portion 101 "clasps" to the rim of a toilet using the rim engaging sides 204,205, the partial rim engaging side 207, and the rim-latching arm 206, and flexibility in the corners 201,202,203. Specifically, rim engaging side 204 sits on the top surface of the rim of a toilet, while partial rim engaging side 207 and rim engaging side 205 rest against the sides of the rim. Corner 203 allows the rim-latching arm 206 to "clasp" the base of the rim while the bowl side bestrider 103 rests against or suspends above the bowl of the toilet. The apparatus 100 thus forms an assembly that is cantilevered from the rim with corner 203 and the rim-latching arm 206 serving as a fulcrum and partial rim engaging side 207 as the fulcrum.

In this illustrative embodiment, a handle 111 extends from partial rim engaging side 207 at an angle 208 of between fifteen and thirty degrees. This angle results in the handle 111 extending from a side of the rim of a toilet, represented in FIG. 2 as line 209, at the same angle 208. Accordingly, when the apparatus 100 of FIGS. 1-5 is coupled to a toilet, the handle 111 would extend from the rim of the toilet at an angle 207 of between fifteen and thirty degrees. This angle 208 allows a user to grasp the handle 111 and manipulate the apparatus 100 without touching the toilet or placing a hand into the interior of a bowl.

Figure 6:
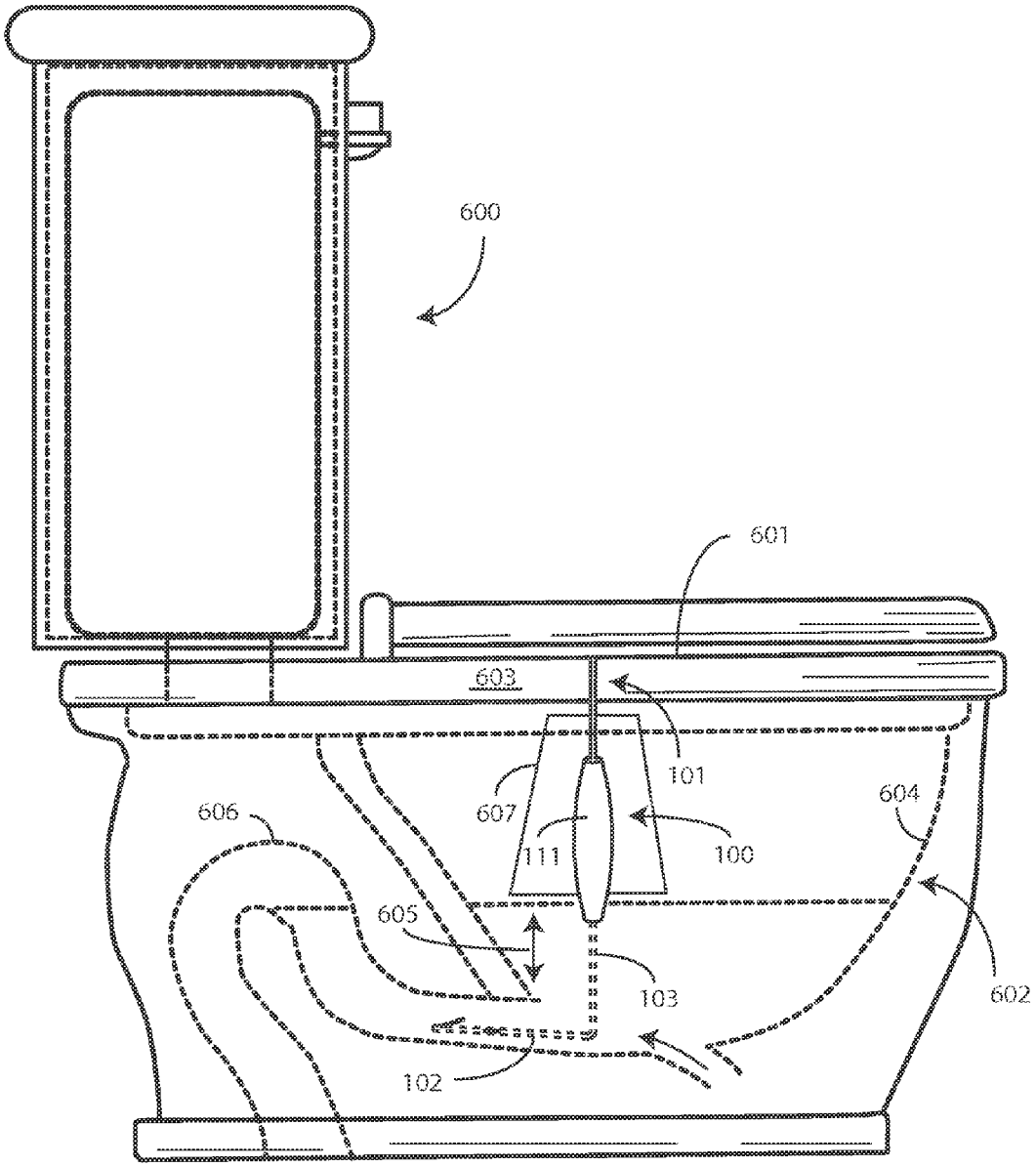
FIG. 6 illustrates one explanatory apparatus configured in accordance with one or more embodiments of the disclosure attached to a first type of toilet.
Figure 7:
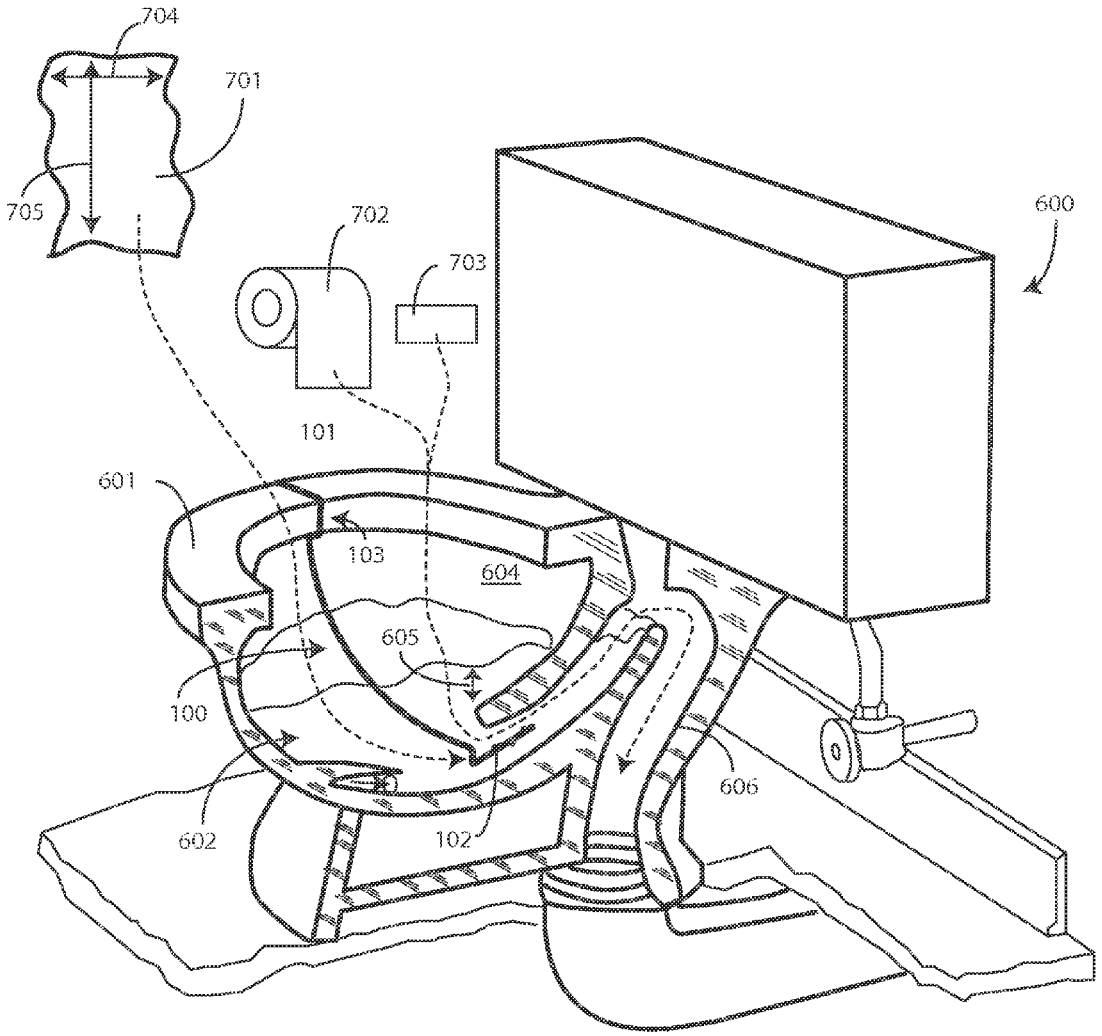
FIG. 7 illustrates one explanatory apparatus configured in accordance with one or more embodiments of the disclosure attached to the first type of toilet.

In one embodiment, when the apparatus is compliant, manipulation of the handle 111 also allows the rim engaging portion 101 to attach and detach to the rim of a toilet. For example, in one embodiment, the sheet catcher 102 can be placed within the water seal of a toilet. The apparatus can then be rotated toward the rim until the rim engaging portion 101 initially contacts the rim. Movement of the handle 111 along direction 210 causes the corners 201,202,203 to open, thereby allowing the rim engaging sides 204,205, the partial rim engaging side 207, and the rim-latching arm 206, to engage the outer perimeter of the rim as shown in FIGS. 6 and 7. Similarly, when the rim engagement portion 101 is attached to the rim, an upward force applied to the handle 111 causes the rim engaging portion 101 to bend and release the rim.

Turning now to FIG. 6, illustrated therein is the apparatus 100 coupled to a pressure-jet assist toilet 600. The rim engaging portion 101 is attached to the rim 601 of the pressure-jet assist toilet 600. The handle 111 is disposed outside the bowl 602 of the pressure-jet assist toilet 600. In one embodiment, the handle 111 extends from the side 603 of the rim 601 of the pressure-jet assist toilet 600 downwardly at an angle of between fifteen and thirty degrees from the side 603 of the rim 601.

The bowl side bestrider 103 passes along an inner contour 604 of the bowl 602. The sheet catcher 102 is disposed within the water seal 605 of the pressure-jet assist toilet 600. In this illustrative embodiment, the sheet catcher 102 at least partially extends into the trapway 606 of the pressure-jet assist toilet 600.

In one or more embodiments, an optional shield 607 can be coupled to the apparatus 100 just above the handle 111. The optional shield 607 can aid in keeping the user from contacting unsanitary matters when using the apparatus. The optional shield 607 can be manufactured from metal, plastic, or other suitable materials.

Turning to FIG. 7, the assembly of FIG. 6 is shown with the pressure-jet assist toilet 600 in a cut-away view. The rim engaging portion 101 is attached to the rim 601 of the toilet 600, and the bowl side bestrider 103 passes along an inner contour 604 of the bowl 602. The sheet catcher 102 is disposed within the water seal 605 of the pressure-jet assist toilet 600, and the sheet catcher 102 at least partially extends into the trapway 606 of the pressure-jet assist toilet 600.

In this configuration, the sheet catcher 102 is configured to catch non-dispersible sheets 701 when the pressure-jet assist toilet 600 is flushed. Examples of non-dispersible sheets 701 include needlepunched and spunlace sheets. Examples of such sheets are marketed by Medline Industries under the names ReadyBath™ and AloeTouch™. These non-dispersible sheets 701 can be configured as soft, single patient use, spunlace or needlepunched wipes that are quite gentle on the skin. Such non-dispersible sheets 701 are versatile and convenient for use as wipes for everyday cleaning and incontinence care. In one or more embodiments, the non-dispersible sheets 701 are pre-moistened with rinse-free formula that cleans, moisturizes and soothes the skin. In one or more embodiments, the non-dispersible sheets can be pH-balanced for patient use, can be hypoallergenic, and alcohol free. In one or more embodiments, the non-dispersible sheets 701 can be provided with a light, gender-neutral scent or, alternatively, free of fragrance.

In one or more embodiments, the sheet catcher 102 catches the non-dispersible sheets 701, but allows other materials to pass. For example, in one embodiment, the barbs (104,105, 106) of the sheet catcher 102 permit paper sheets 702 or other dispersible sheets to pass when the pressure-jet assist toilet 600 is flushed. In one embodiment, the barbs (104,105,106)

of the sheet catcher 102 also allow human waste 703 to pass when the pressure-jet assist toilet 600 is flushed, as shown. As noted above, this was confirmed when simulated human waste configured in accordance with the MaP protocol was tested during the experimental testing sessions.

Experimental testing has shown that the apparatus 100 is well suited to work with non-dispersible sheets having different dimensions. For example, in one embodiment, the non-dispersible sheets 701 have a width 704 of between five and eight inches. In one embodiment, the non-dispersible sheets 701 have a length 705 of between seven and twelve inches. Examples of sizes of the non-dispersible sheets 701 include 5.5"×7.25", 8"×8", and 8"×12". These dimension examples are illustrative only, as others will be obvious to those of ordinary skill in the art having the benefit of this disclosure.

Apparatuses in accordance with embodiments of the disclosure provide a unique device to catch any non-dispersible sheets 701 that may enter a drain or septic system via toilet flushing. As noted above, an apparatus 100 can be used to allow toilet paper and human waste to pass through the sheet catcher 102 while preventing non-dispersible sheets 701 from passage. Embodiments of the disclosure advantageously allow a user to extract the entire unit from the pressure-jet assist toilet 600 to remove the non-dispersible sheet 701 without reaching into the bowl 602. This reduces the risk of user contact with the sheet catcher 102 or the barbs (104,105, 106), which is a problem with prior art designs.

Figure 8:
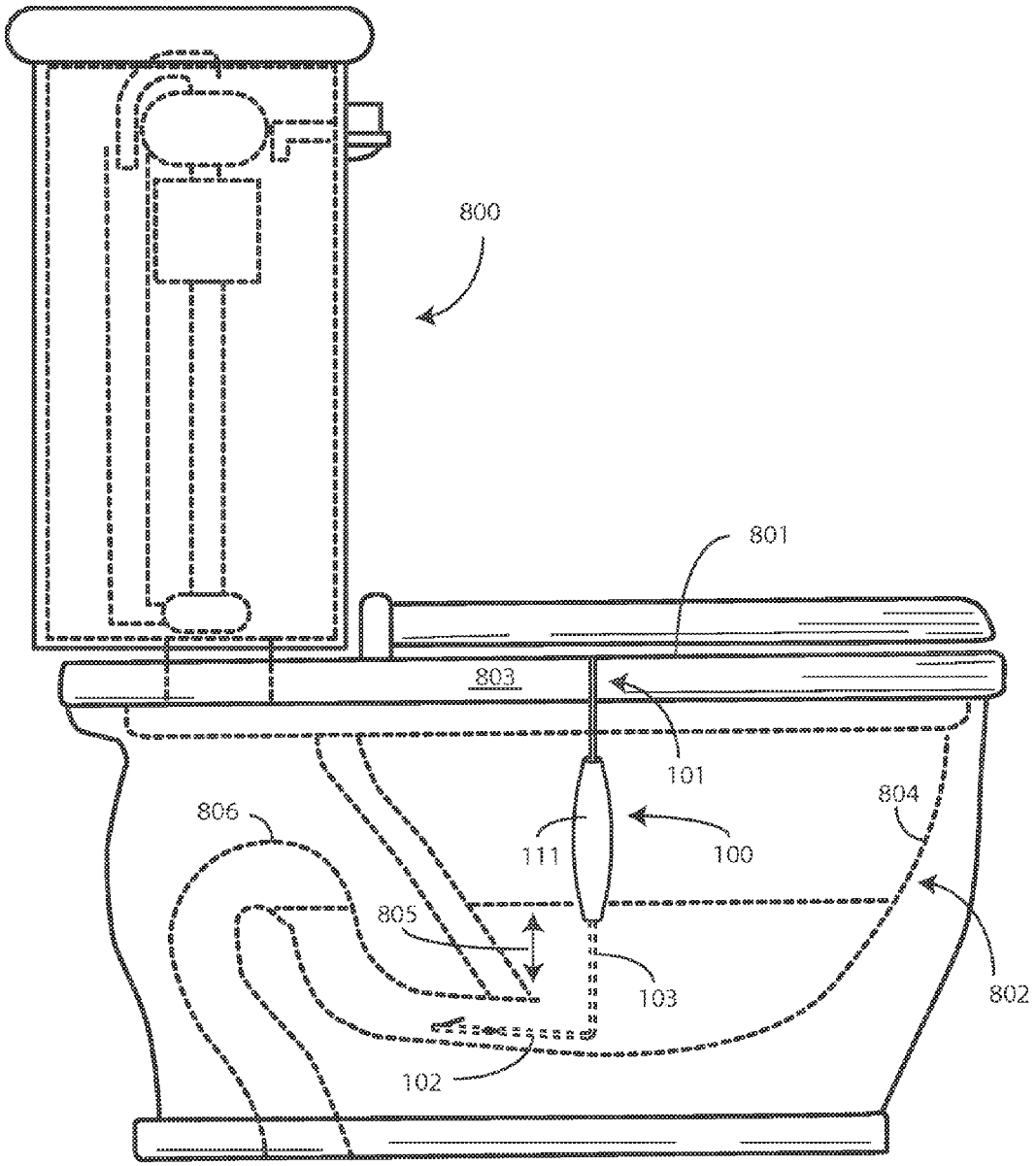
FIG. 8 illustrates one explanatory apparatus configured in accordance with one or more embodiments of the disclosure attached to a second type of toilet.

Turning now to FIG. 8, illustrated therein is the apparatus 100 coupled to a conventional toilet 800. The rim engaging portion 101 is attached to the rim 801 of the conventional toilet 800. The handle 111 is disposed outside the bowl 802 of the conventional toilet 800. In one embodiment, the handle 111 extends from the side 803 of the rim 801 of the conventional toilet 800 downwardly at an angle of between fifteen and thirty degrees from the side 803 of the rim 801.

The bowl side bestrider 103 passes along an inner contour 804 of the bowl 802. The sheet catcher 102 is disposed within the water seal 805 of the conventional toilet 800. In this illustrative embodiment, the sheet catcher 102 at least partially extends into the trapway 806 of the conventional toilet 800.

Figure 9:
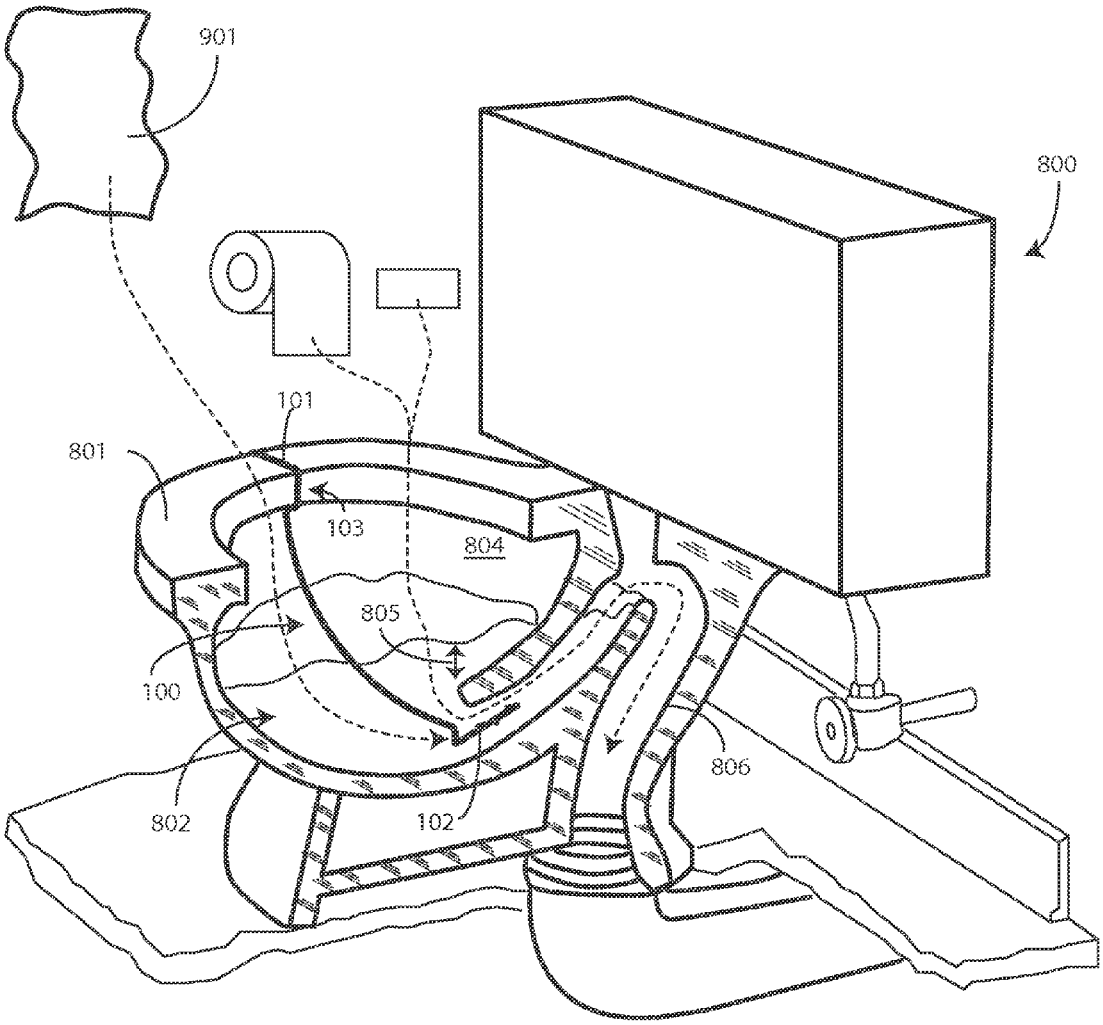
FIG. 9 illustrates one explanatory apparatus configured in accordance with one or more embodiments of the disclosure attached to the second type of toilet.

Turning to FIG. 9, the assembly of FIG. 8 is shown with the conventional toilet 800 in a cut-away view. The rim engaging portion 101 is attached to the rim 801 of the conventional toilet 800, and the bowl side bestrider 103 passes along an inner contour 804 of the bowl 802. The sheet catcher 102 is disposed within the water seal 805 of the conventional toilet 800, and the sheet catcher 102 at least partially extends into the trapway 806 of the conventional toilet 800. In this configuration, the sheet catcher 102 is configured to catch non-dispersible sheets 901 when the conventional toilet 800 is flushed.

Figure 10:
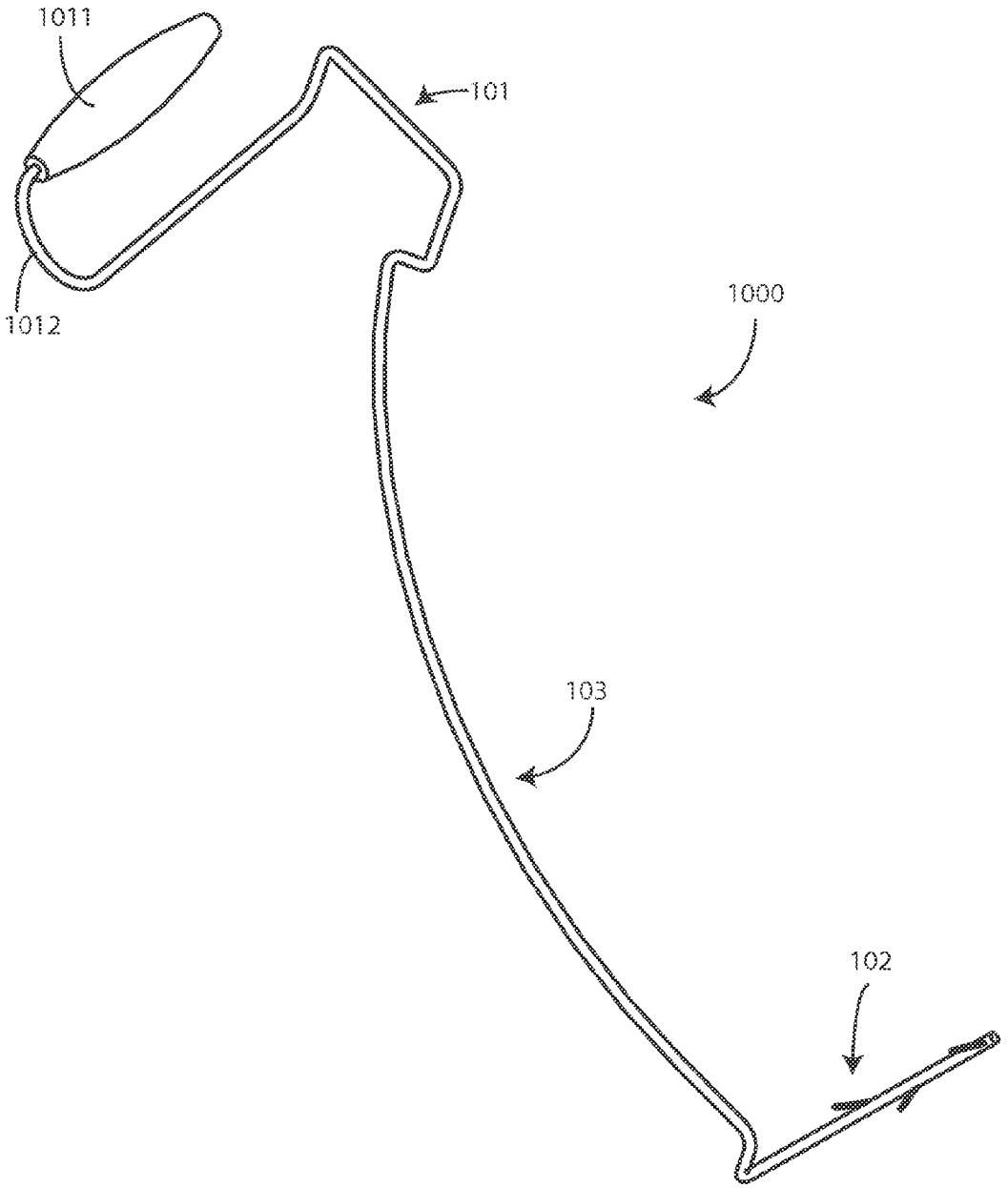
FIG. 10 illustrates a perspective view of another explanatory apparatus configured in accordance with one or more embodiments of the disclosure.
Figure 11:
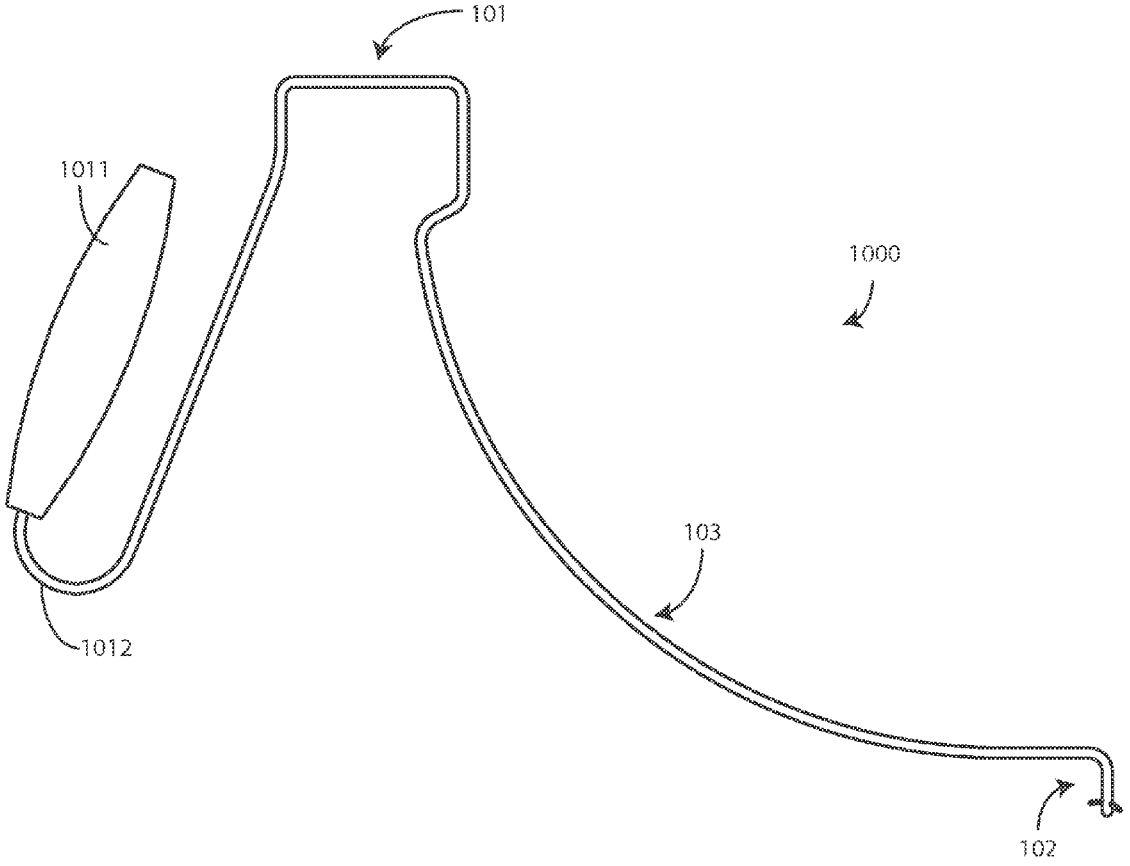
FIG. 11 illustrates a side elevation view of another explanatory apparatus configured in accordance with one or more embodiments of the disclosure.

Turning now to FIGS. 10 and 11, illustrated therein is an alternate apparatus 1000 configured in accordance with one or more embodiments of the disclosure. As with the apparatus (100) of FIG. 1, the apparatus 1000 of FIGS. 10 and 11 includes a rim engagement portion 101, a sheet catcher 102, and a bowl side bestrider 103. In this embodiment, the bowl side bestrider 103 couples the rim engagement portion 101 to the sheet catcher 102.

The apparatus 1000 differs from apparatus (100) in the design of the handle 1011. The handle 1011 extends from an additional U-shaped curve 1012 so as to be farther from the rim engagement portion 101. Accordingly, a user can manipulate the apparatus from a position even farther from the rim (601) of a toilet.

Figure 12:
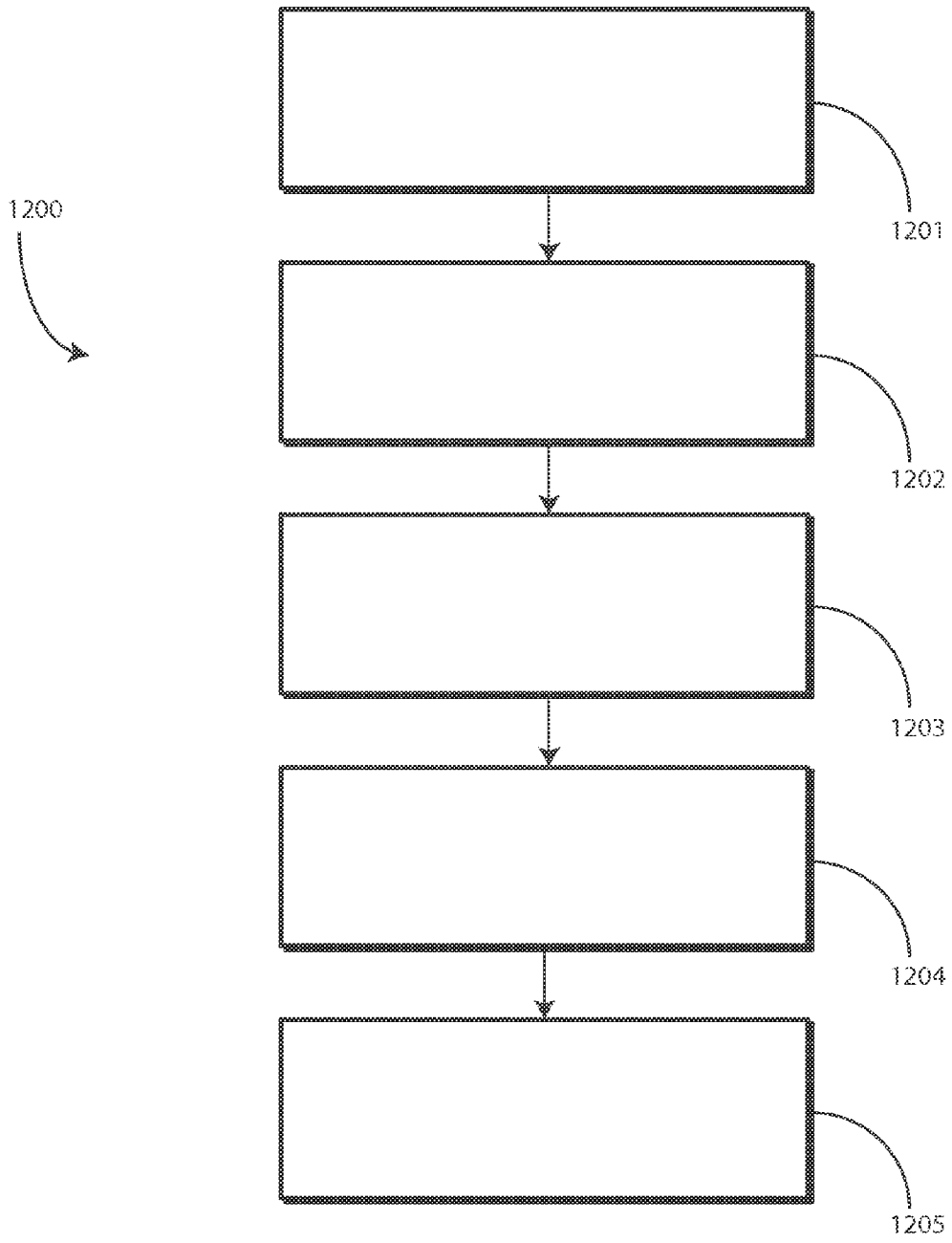
FIG. 12 illustrates an explanatory method in accordance with one or more embodiments of the disclosure.

Turning now to FIG. 12, illustrated therein is one explanatory method 1200 of using an apparatus configured in accordance with one or more embodiments of the disclosure. At step 1201, a user disposed a sheet catcher in a water seal of a toilet. At step 1202, the user places a bowl side bestrider against the inner surface of a bowl of the toilet. At step 1203, the user attaches a rim engagement portion to the rim of the toilet. Steps 1201,1202,1203 can optionally be accomplished by manipulating a handle of the apparatus in one or more embodiments so that the user neither has to touch the toilet nor place their hands within the confines of the bowl.

At step 1204, non-dispersible sheets are caught with one or more barbs of the sheet catcher when the toilet is flushed. At step 1204 the method 1200 can include allowing one or more of human waste, dispersible product, paper sheets, or combinations thereof, to pass the barbs of the sheet catcher. At step 1205, the user may detach the apparatus from the rim and discard the caught sheet.

Figure 13:
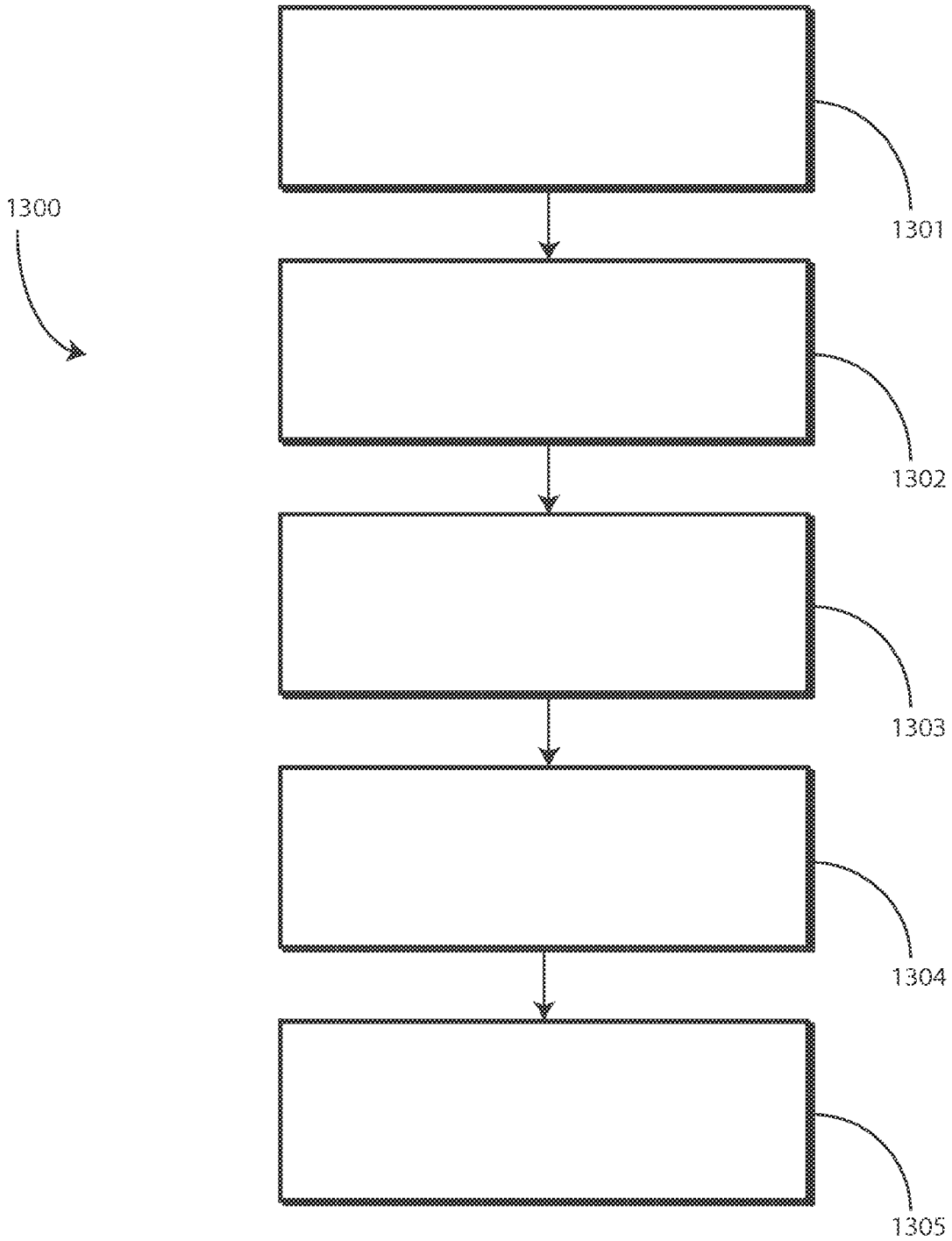
FIG. 13 illustrates an explanatory method in accordance with one or more embodiments of the disclosure.

Turning now to FIG. 13, illustrated therein is a method 1300 of manufacturing an apparatus in accordance with one or more embodiments of the disclosure. At step 1301, the method 1300 includes applying one or more barbs to a sheet catcher. At step 1302, the method can include forming a bowl side bestrider that extends from the sheet catcher. At step 1303, the method 1300 can include further forming a rim engagement portion extending from the bowl side bestrider. At step 1304, the method 1300 can include attaching a handle to an extension from the rim engagement portion. At optional step 1305, the method can include attaching a shield to the apparatus between the handle and the rim engagement portion.

Figure 14:
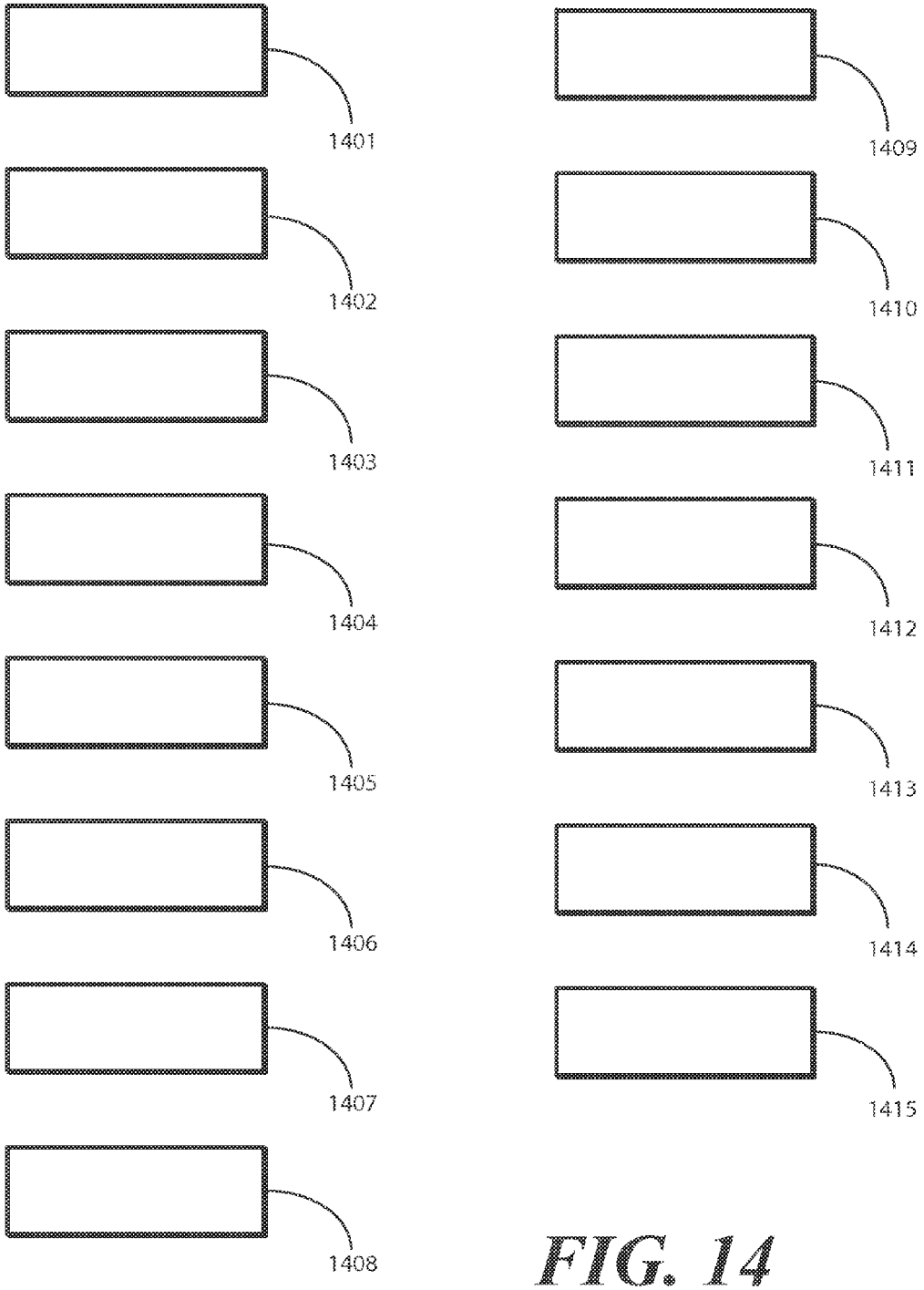
FIG. 14 illustrates various embodiments of the disclosure.

Turning now to FIG. 14, illustrated therein are various embodiments of the disclosure. At 1401, an apparatus for a toilet includes a rim engagement portion, a sheet catcher comprising one or more barbs, and a bowl side bestrider coupling the rim engagement portion to the sheet catcher. In one embodiment, the sheet catcher of 1401 is to situate within a water seal of the toilet when the rim engagement portion engages a rim of the toilet. In one embodiment, the one or more barbs at 1401 are to catch material sheets when the toilet is flushed.

At 1402, the sheet catcher of 1401 is to at least partially extend into a trapway of the toilet. At 1403, the sheet catcher of 1402 is between four and five inches in length. At 1404, the one or more barbs of 1401 comprise three barbs. At 1405, the three barbs of 1404 are spaced from each other about an axis of the sheet catcher.

At 1406, the apparatus of 1401 comprises a handle extending from the rim engagement portion. At 1407, the handle extends from a side of the rim of the toilet at an angle of between fifteen and thirty degrees. At 1407, the apparatus of 1406 is manufactured from a pliant metal.

At 1409, the rim engaging portion of 1408 comprises three or fewer corners. At 1409, the rim engaging portion of 1408 can bend or otherwise deform to release the rim in response to upward force applied to the handle.

At 1410, the bowl side bestrider of 1401 has a radius of between seven and eight inches. At 1411, the barbs of 1401 permit paper sheets to pass when the toilet is flushed. At 1412, the barbs of 1401 allow human waste to pass when the toilet is flushed.

At 1413, the non-dispersible sheets of 1401 are manufactured from one of needlepunched material or spunlace material. At 1414, the non-dispersible sheets of 1401 are between five and eight inches in width. At 1415, the non-dispersible sheets of 1401 are between seven and twelve inches in length.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. For example in the embodiment shown in FIGS. 6 and 7, the apparatus is manufactured so that it will be placed on the left side of the rim of the toilet (when viewing the toilet straight on, i.e., along the y-axis defined by the sheet catcher) with the rim engaging portion resting against the rim so that the seat can be lowered over it. In this configuration, the patient cannot contact the apparatus. It is accordingly formed to stay out of the way of the "drop zone" by simply hanging it from the rim. Moreover, when installing the apparatus, the user does not need to contact the water in the bowl. When an errant non-dispersible sheet is caught, anyone can easily and safely grip the handle, lift the apparatus with captured cloth out of the toilet and throw it away. Apparatuses configured in accordance with embodiments of the disclosure could further be configured to be reusable or single use (disposable).

Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims of this application and all equivalents thereof.

What is claimed is:

1. An apparatus for a toilet, comprising:

a rim engagement portion;

a sheet catcher comprising one or more barbs; and a bowl side bestrider coupling the rim engagement portion to the sheet catcher;

the sheet catcher to situate within a water seal of the toilet when the rim engagement portion engages a rim of the toilet; and the one or more barbs to catch non-dispersible sheets when the toilet is flushed.

2. The apparatus of claim 1, the sheet catcher to at least partially extend into a trapway of the toilet.

3. The apparatus of claim 2, the sheet catcher between four and five inches in length.

4. The apparatus of claim 1, the one or more barbs comprising three barbs.

5. The apparatus of claim 4, the three barbs spaced from each other about an axis of the sheet catcher.

6. The apparatus of claim 1, further comprising a handle extending from the rim engagement portion.

7. The apparatus of claim 6, the handle extending from a side of the rim of the toilet at an angle of between fifteen and thirty degrees.

8. The apparatus of claim 6, the apparatus manufactured from a pliant metal.

9. The apparatus of claim 8, the rim engagement portion:

comprising three or fewer corners;

to release the rim in response to upward force applied to the handle.

10. The apparatus of claim 1, the bowl side bestrider having a radius of between seven and eight inches.

11. The apparatus of claim 1, the one or more barbs to permit dispersible sheets to pass when the toilet is flushed.

12. The apparatus of claim 1, the one or more barbs to allow human waste to pass when the toilet is flushed.

13. The apparatus of claim 1, the non-dispersible sheets manufactured from one of needlepunched material or spunlace material.

14. The apparatus of claim 13, the non-dispersible sheets between five and eight inches in width.

15. The apparatus of claim 13, the non-dispersible sheets between seven and twelve inches in length.

16. A method, comprising:

disposing a sheet catcher in a water seal of a toilet;

attaching a rim engagement portion to a rim of the toilet; and catching non-dispersible sheets with one or more barbs of the sheet catcher when the toilet is flushed.

17. The method of claim 16, further comprising permitting one or more of human waste or dispersible sheets to pass when the toilet is flushed.

18. The method of claim 16, further comprising placing a bowl side bestrider against an inner surface of a bowl of the toilet.

* * * * *